US008689772B2

(12) United States Patent
Hefler et al.

(10) Patent No.: US 8,689,772 B2
(45) Date of Patent: Apr. 8, 2014

(54) FUEL INJECTOR WITH TELESCOPING ARMATURE OVERTRAVEL FEATURE

(75) Inventors: Gregory William Hefler, Chillcothe, IL (US); Adam Leonard Stecklein, Peoria, IL (US); Daniel Richard Ibrahim, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 489 days.

(21) Appl. No.: 13/111,477

(22) Filed: May 19, 2011

(65) Prior Publication Data

US 2012/0291753 A1 Nov. 22, 2012

(51) Int. Cl.
*F02M 59/46* (2006.01)
*F16K 31/02* (2006.01)

(52) U.S. Cl.
USPC ..... 123/467; 239/96; 239/585.5; 251/129.19

(58) Field of Classification Search
USPC ..... 123/467; 251/129.19; 335/257–258, 335/270–277; 239/88–96, 585.5
See application file for complete search history.

(56) References Cited

U.S. PATENT DOCUMENTS

| | | | | |
|---|---|---|---|---|
| 4,008,876 | A * | 2/1977 | Bastle | 251/129.19 |
| 4,666,125 | A * | 5/1987 | Marts et al. | 251/129.19 |
| 4,938,451 | A * | 7/1990 | Weaver et al. | 251/129.14 |
| 5,139,224 | A * | 8/1992 | Bright | 251/50 |
| 5,396,926 | A * | 3/1995 | Pataki et al. | 137/596.17 |
| 5,487,407 | A * | 1/1996 | Eaker | 137/522 |
| 5,727,738 | A | 3/1998 | Hofmann et al. | |
| 6,029,682 | A | 2/2000 | Lewis et al. | |
| 6,209,524 | B1 | 4/2001 | Itoh | |
| 6,439,214 | B1 * | 8/2002 | Yew | 123/568.21 |
| 6,510,841 | B1 | 1/2003 | Stier | |
| 6,796,543 | B2 | 9/2004 | Haeberer et al. | |
| 6,811,105 | B2 | 11/2004 | Kato et al. | |
| 6,837,451 | B2 * | 1/2005 | Rodriguez-Amaya et al. | 239/533.2 |
| 6,945,508 | B2 | 9/2005 | Lewis et al. | |
| 6,997,432 | B2 * | 2/2006 | Rapp | 251/129.16 |
| 7,156,368 | B2 | 1/2007 | Lucas et al. | |
| 7,422,166 | B2 | 9/2008 | Hoffmann et al. | |
| 2003/0052291 | A1 * | 3/2003 | Roth | 251/129.15 |
| 2003/0084571 | A1 | 5/2003 | D'Arrigo | |
| 2003/0141475 | A1 * | 7/2003 | Ruthardt et al. | 251/129.16 |
| 2010/0006679 | A1 | 1/2010 | Manubolu et al. | |
| 2010/0018503 | A1 | 1/2010 | Perry et al. | |

FOREIGN PATENT DOCUMENTS

| | | |
|---|---|---|
| JP | 62201389 | 8/1987 |

* cited by examiner

*Primary Examiner* — Thomas Moulis
(74) *Attorney, Agent, or Firm* — Liell & McNeil

(57) ABSTRACT

A common rail fuel injector includes a fuel inlet, a set of nozzle outlets, a drain outlet, a nozzle chamber and a needle control chamber. A needle control valve includes a ceramic control valve member movable between a closed position in contact with a flat valve seat to block the needle control chamber from the drain outlet, and an open position at which the needle control chamber is fluidly connected to the drain outlet. A solenoid actuator is mounted in the injector body and includes an armature movable between an overtravel position and an energized position, but the armature has a stable unenergized position between the overtravel position and the energized position. A needle valve member is positioned in the injector body and includes an opening hydraulic surface exposed to fluid pressure in the nozzle chamber, and a closing hydraulic surface exposed to fluid pressure in the needle control chamber. Armature overtravel is facilitated by a telescoping armature pin that includes a stem affixed to the armature and telescopically received in a pusher in contact with the ceramic control valve member.

20 Claims, 2 Drawing Sheets

FUEL INJECTOR WITH TELESCOPING ARMATURE OVERTRAVEL FEATURE

TECHNICAL FIELD

The present disclosure relates generally to electronically controlled valves for fuel injectors, and more particularly to a telescoping armature overtravel feature for a common rail fuel injector.

BACKGROUND

In order to provide a commercially viable fuel system, especially for compression ignition engines, fuel injector manufacturers must satisfy an often contradictory set of performance demands, manufacturability requirements and robustness issues. Among the different performance demands are the need of the fuel injector to have the ability to inject a broad range of fuel volumes, with this problem being compounded by the need to often inject the minimal quantity close in time to another larger injection event. Among the manufacturability requirements is the need to minimize part count, devise a realistic assembly strategy and provide geometrical tolerances that result in mass produced fuel injectors that respond similarly to identical control signals. On top of these requirements are a need for the fuel injector to exhibit a durable lifespan while retaining predictable responses to control signals over its working life in the face of wear and tear in the hostile environment of an internal combustion engine.

One specific type of fuel injector that has seen considerable success, especially in relation to compression ignition engines, utilizes a so called common rail to supply pressurized fuel to individual fuel injectors mounted for direct injection in individual engine cylinders. In order to reduce undesirable emissions, such as soot and/or NOx, the fuel injector must often need to be precisely controlled to produce a sequence of fuel injection events of differing fuel volumes in precise timings. In many common rail fuel injectors, the nozzle outlets are opened and closed by a needle valve member that has a closing hydraulic surface exposed to fluid pressure in a needle control chamber, whose pressure is controlled by an electronically controlled valve. Short dwell times between injection events require that the moving components within the fuel injector settle out and reset prior to initiating a subsequent injection event in the often short dwell time between desired injection events. In addition, undesirable secondary injection events due to a valve bouncing off a valve seat can sometimes be a problematic issue. In this regard, U.S. Pat. No. 7,156,368 teaches a flow control valve that allows the armature of the electrical actuator to overtravel, and thus decouple from, the valve member after the valve member contacts its seat in order to reduce momentum, and supposedly avoid bouncing, when the valve member impacts its seat to end an injection event. While the '368 patent teaches a flow control valve structure and overtravel feature that may limit valve bounce, it may do so at the expense of other manufacturability, performance and robustness degradations.

The present disclosure is directed toward one or more of the problems set forth above.

SUMMARY OF THE DISCLOSURE

In one aspect, a fuel injector includes an injector body that defines a fuel inlet, a set of nozzle outlets and a drain outlet, and further includes a nozzle chamber and a needle control chamber disposed therein. A needle control valve includes a control valve member movable between a closed position in contact with a valve seat at which the needle control chamber is blocked to the drain outlet, and an open position out of contact with the valve seat at which the needle control chamber is fluidly connected to the drain outlet. An electrical actuator is mounted in the injector body and includes an armature movable between an overtravel position and an energized position, but having a stable un-energized position between the overtravel position and the energize position. A needle valve member is positioned in the injector body and includes an opening hydraulic surface exposed to fluid pressure in the nozzle chamber, and a closing hydraulic surface exposed to fluid pressure in the needle control chamber. A telescoping armature pin includes a stem affixed to the armature and a pusher in contact with the control valve member, with one of the stem and pusher being telescopically received in the other of the stem and pusher.

In another aspect, a common rail fuel system includes a common rail with a high pressure inlet and a plurality of high pressure outlets. A plurality of fuel injectors each includes a common rail inlet fluidly connected to one of the plurality of high pressure outlets, and further includes an electronically controlled valve with an armature movable between an overtravel position and an energized position. The armature also has a stable un-energized position between the overtravel position and the energized position. The electronically controlled valve includes a telescoping armature pin with a stem affixed to the armature and a pusher in contact with a control valve member. The pusher telescopically receives the stem. The high pressure pump has an outlet fluidly connected to the high pressure inlet of the common rail, and a low pressure inlet fluidly connected to a fuel tank. Each of the fuel injectors includes a drain outlet fluidly connected to the fuel tank.

In still another aspect, a method of operating a fuel injector includes initiating an injection event by moving an armature from a stable un-energized position toward an energized position, and hydraulically pushing a control valve member from a closed position toward an open position. The injection event is ended by moving the armature from the energized position toward the stable un-energized position, and mechanically pushing the control valve member toward the closed position. Bounce of the control valve member off a valve seat is inhibited by moving the armature beyond the stable un-energized position toward an overtravel position after the control valve member has reached a closed position. The bounce inhibiting step includes telescopically moving a stem affixed to the armature in a pusher in contact with the control valve member.

DETAILED DESCRIPTION

Figure 1:
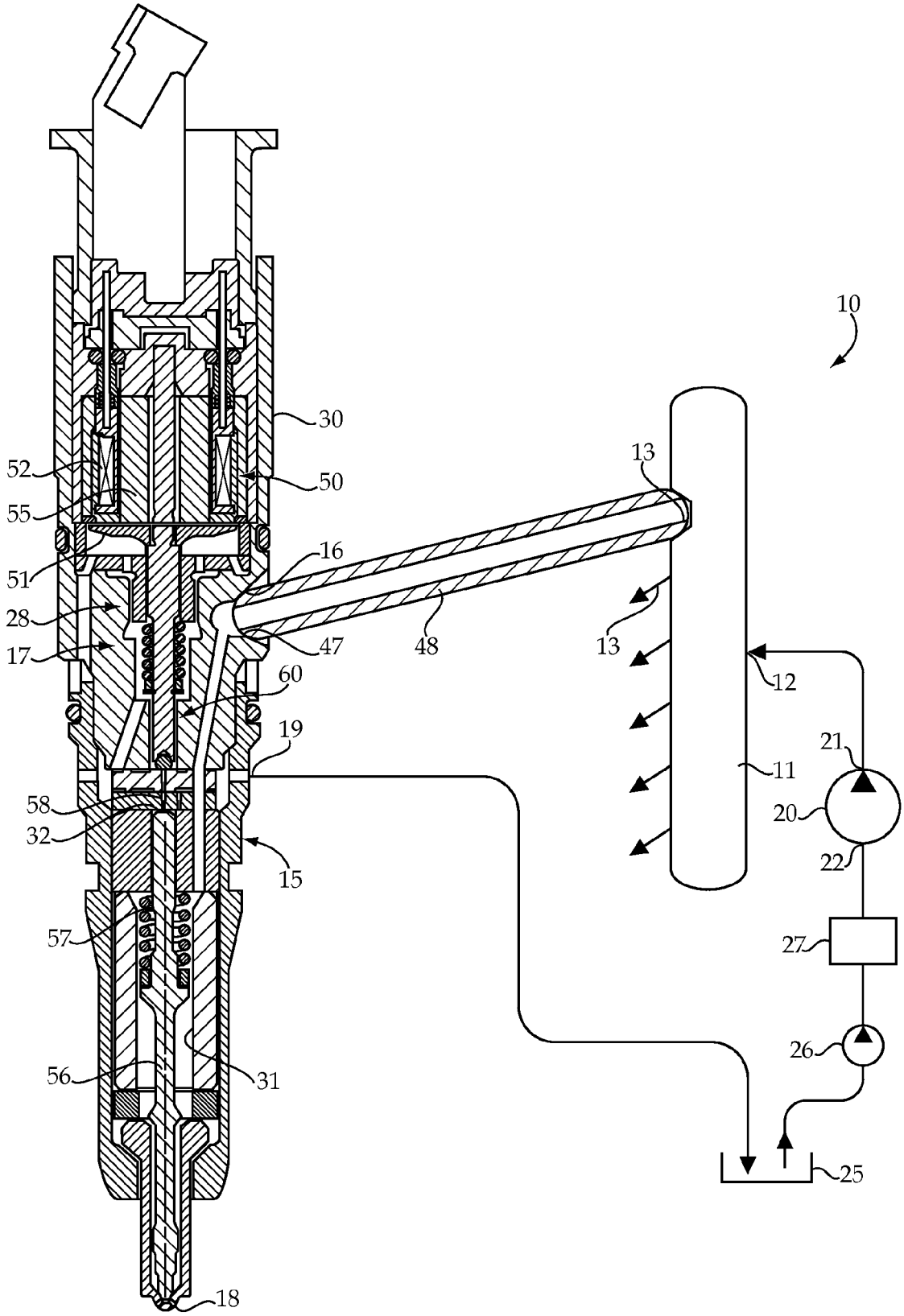
FIG. 1 is a schematic view of a common rail fuel system according to one aspect of the present disclosure.

Referring to FIG. 1, a common rail fuel system 10 includes a common rail 11 with a high pressure inlet 12 and a plurality of high pressure outlets 13. In a normal application, the common rail would include one high pressure outlet 13 for each engine cylinder, and FIG. 1 shows six outlets for purposes of example. A plurality of fuel injectors 15 each include a common rail inlet 16 fluidly connected to one of the plurality of high pressure outlets 13 from the common rail. Only one fuel injector 15 is shown in FIG. 1. The fluid connection between common rail 13 and each of the fuel injectors 15 may be accomplished by an individual quill 48 that may have rounded ends that are compressed between a conical seat 47 of common rail inlet 16 and a similar conical seat associated with high pressure outlet 13 of common rail 11. As used in this disclosure, the term "common rail inlet" means a high pressure inlet that includes a conical seat 47. Each of the fuel injectors 15 includes an electronically controlled valve 17 with an armature 51 that is movable between an overtravel position and an energized position, but has a stable un-energized position (as shown) between the overtravel position and the energized position. The electronically controlled valve 17 is also notable for including a telescoping armature pin 60 that facilitates overtravel of armature 51 at the end of an injection event. A high pressure pump 20 includes an outlet 21 that is fluidly connected to the high pressure inlet 12 of common rail 11. High pressure pump 20 also includes a low pressure inlet 22 fluidly connected to a fuel tank 25, such as via a low pressure fuel transfer pump 26 and one or more filters 27. Each of the fuel injectors 15 also includes a drain outlet 19 fluidly connected to the fuel tank 25. Although fuel injectors 15 are constructed to have virtually no leakage, high pressure fuel is utilized for the control function, and thus some fuel finds its way to the drain outlet 19 for recirculation back to tank 25. Each of the fuel injectors 15 includes an injector body 30 that defines the common rail inlet 16, the drain outlet 19 and also defines a set of nozzle outlets 18, which may be positioned for direct injection into an individual cylinder of a compression ignition engine (not shown).

Figure 2:
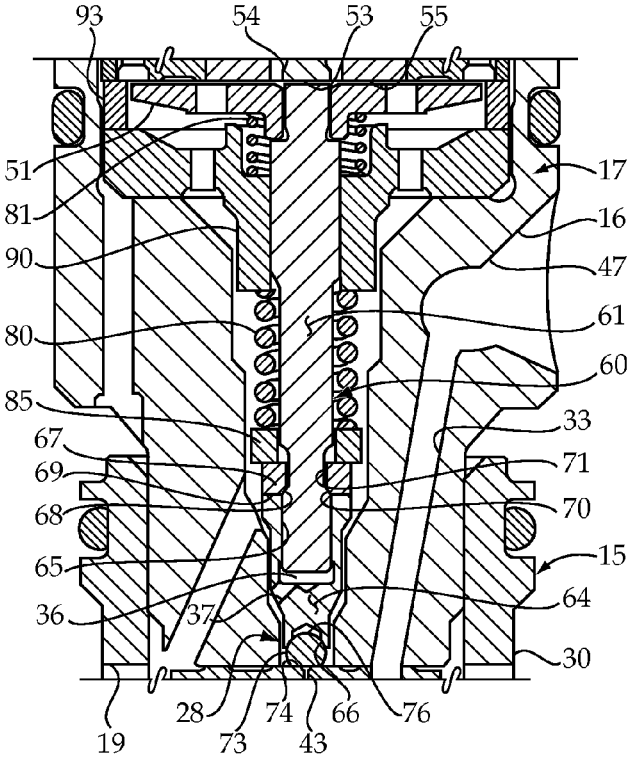
FIG. 2 is a front sectioned view through the needle control valve portion of the fuel injector shown in FIG. 1.
Figure 3:
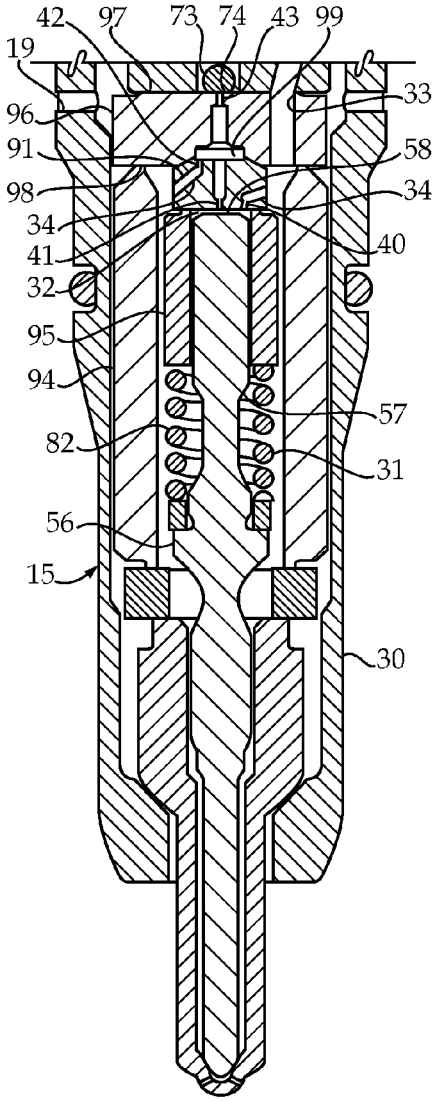
FIG. 3 is a front sectioned view of the nozzle group portion of the fuel injector from FIG. 1.
Figure 4:
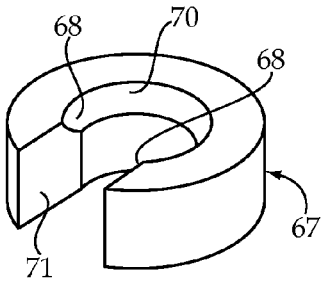
FIG. 4 is a perspective view of a clip used in the telescoping armature pin of the control vale shown in FIG. 2.

Referring in addition to FIGS. 2-4, the internal structure of each of the fuel injectors 15 may be better appreciated. Injector body 30 includes a nozzle chamber 31 and a needle control chamber 32 disposed therein. The term "injector body" is used to refer to components of fuel injector 15 that remain fixed or stationary relative to one another throughout operation of fuel system 10. As with most fuel injectors that include a direct control needle valve, each fuel injector 15 includes a needle valve member 56 with an opening hydraulic surface 57 exposed to fluid pressure in nozzle chamber 31 and a closing hydraulic surface 58 exposed to fluid pressure in needle control chamber 32. Nozzle chamber 31 is fluidly connected to common rail inlet 16 by a nozzle supply passage 33. Needle valve member 56 is shown in its downward seated closed position that blocks the fluid connection between nozzle chamber 31 and nozzle outlets 18. When needle valve member 56 lifts to an open position, a fuel injection event occurs by the fluid connection between nozzle chamber 31 and nozzle outlets 18. Between injection events, the pressure in nozzle chamber 31 should be about the same as the pressure in common rail 11. In addition, between injection events the pressure in needle control chamber 32 should be the same as that in nozzle chamber 31 due to the always open fluid connection via two unobstructed passageways 34 between nozzle chamber 31 and needle control chamber 32.

The injector body 30 may include a pressure containment sleeve 94 that is out of contact with needle valve member 56, but defines a segment of nozzle chamber 31. A small cylinder 95 may, along with needle valve member 56 and an insert 91, define needle control chamber 32. Needle valve member 56 is normally biased toward a closed position by a biasing spring 82, which also biases small cylinder 95 and hence insert 91 in an opposite upward direction to seat insert 91 against disk 96 of injector body 30. Needle valve member 56 may be hydraulically neutral when in its upward open position such that the effective area of closing hydraulic surface 58 is about equal to the effective area of needle valve member 56 exposed to fluid pressure in nozzle chamber 31. With this strategy, and when the pressures in nozzle chamber 31 and needle control chamber 32 are made equal, such as at the end of an injection event, the rate at which needle valve member 56 moves downward toward its closed position is very predictably based upon a predetermined preload on biasing spring 82.

The electronically controlled valve 17 includes a needle control valve 28 coupled to an electrical actuator 50 that includes a solenoid coil 52 electromagnetically coupled to an armature 51. Needle control valve 28 includes a control valve member 73 that is movable between a closed position (as shown) in contact with a flat valve seat 74 at which the needle control chamber 32 is fluidly blocked from drain outlet 19. Control valve member 73 may be moved to an open position out of contact with flat valve seat 74 at which the needle control chamber 32 becomes fluidly connected to drain outlet 19. Flat seat 74 may be provided on one side of disk 96 with a conical insert seat 99 located on the opposite side 98 of disk 96. The opposite side 98 of disk 96 may define a portion of nozzle chamber 31. Although not necessary, control valve member 73 may be constructed from a suitable ceramic material to include a spherical surface 76 that may be machined to include a flat surface that engages flat valve seat 74. Nevertheless, those skilled in the art will appreciate that valve seat 74 could have a conical shape and valve member 74 could have a completely spherical shape or a spherical surface to engage the valve seat without departing from the intended scope of the present disclosure. When electrical actuator 50 is de-energized, a valve spring 80 biases control valve member 73 in a downward closed position in contact with flat valve seat 74 via a pre-load spacer 85, a clip 67 and a pusher 64 that is a portion of a telescoping armature pin 60. Pusher 64 may include an annular orientation neutral surface 66 that contacts the outer spherical surface 76 of control valve member 73 so that flat surface on control valve member 73 can quickly find a parallel relationship with flat valve seat 74 regardless of any small misalignments in the injector structure due to geometrical tolerances and assembly issues.

Telescoping armature pin 60 includes a stem 61 affixed to move with armature 51, and the pusher 64 that is in contact with control valve member 73 as previously described. The telescoping action of telescoping armature pin 60 may be accomplished by one of the stem 61 and pusher 64 being telescopically received in the other of the stem 61 in pusher 64. In the illustrated embodiment, stem 61 is received in a guide bore 65 defined by pusher 64. Together, pusher 64 and one end of stem 61 may define a fluid chamber 36 that is always fluidly connected to drain 19 by a fluid displacement passage 37. An overtravel spring 81 normally biases stem 61 and armature 51 in an upward direction so that stem 61 engages a frustoconical surface 70 of clip 67. As best shown in FIG. 4, clip 57 includes a slot 71 that receives stem 61. The clip is inhibited from sliding back off of stem 61 in the direction of slot 71 due to contact between a retention shoulder 68 and an annular bevel of stem 61. In the illustrated embodiment, retention shoulder 68 is the portion of frustoconical surface 70 adjacent opposite edges of slot 71. Those skilled in the art will appreciate that other geometry that includes a telescoping armature pin would also fall within the intended scope of this disclosure. Between injection events, a thrust surface 69 of clip 67 contacts a top surface of pusher 64 to hold control valve member 73 in its closed position, as shown.

When solenoid coil 52 is un-energized, armature 51 will come to rest at a stable un-energized position, as shown in which armature 51 is separated from stator 55 by an initial air gap. When coil 52 is energized, armature 51 is pulled upward until stem 61 contacts a stop 53 which may be one end of a pin 54 extending through electrical actuator 50. When stem 61 is in contact with stop 53, armature 51 may be considered to be at its energized position at which it is separated from stator 55 by a final air gap that is smaller than the initial air gap. Desired perpindicularity between the underside surface of stator 55 and the line of movement of armature 51 may be aided by guiding stem 61 in a guiding contact interaction with guide component 90 of injector body 30. A valve spring 80 may be positioned between guide component 90 and pusher 64, whereas overtravel spring 81 may be positioned between guide component 90 and armature 51. Other configurations would also fall within the intended scope of the present disclosure. The initial air gap may be sized by selecting an appropriate height by ring 93, which is also a part of injector body 30. When mass producing fuel injectors 15, ring 93 may be a category part in which virtually identical rings of different heights are available to the assembler. This allows the manufacturer to select an appropriate height of ring 93 to remove variances that might otherwise occur so that different fuel injectors are set to have virtually identical initial air gaps despite the build up of small geometrical differences among different fuel injectors due to tolerances of various components. As shown, ring 93 may surround armature 51. This helps to insure that different fuel injectors respond similarly to identical control signals when energized. When armature 51 and stem 61 are pulled in the direction of stator 55, clip 67 and preload spacer 85 move upward to compress valve spring 80. When this occurs, thrust surface 69 of clip 67 may or may not disconnect from contact with pusher 64. However, this movement permits pressure in needle control chamber 32 to hydraulically push control valve member 73 upward out of contact with flat seat 74. The speed at which this event occurs may allow pusher 64 and clip 67 to remain in contact at all times even though control valve member 73 is being hydraulically pushed off of its seat 74 rather than being mechanically pulled off of the same.

Needle control chamber 32 is always fluidly connected to nozzle chamber 31 by two unobstructed passageways 34, one of which includes a Z-orifice 40 and the other passageway includes both an A-orifice 41 and an F-orifice 42. The term "unobstructed" is intended to mean that the passageways are always open and are free of valves, such as a check valve. However, the practitioner can affect performance of fuel injector 15 by appropriately sizing the flow areas through the F-orifice 42 the A-orifice 41, the Z-orifice 40, which are all defined by insert 91, as well as an E-orifice 43 that may be defined by disk 96. However, the effects of different sizings of these various orifices is outside the scope of this disclosure and may be found in a companion and co-owned patent application. In any event, any known structure or number of orifices, such as structures that include only an A and Z orifice fall within the scope of the present disclosure. When control valve member 73 is in its open position, the pressure in needle control chamber 32 drops due to the open fluid connection between needle control chamber 32 and drain 19 through the A-orifice 41 and the E-orifice 33.

Fuel injector 15 may be considered to have a stable non-injection configuration that includes the armature 51 being at its stable un-energized position, as shown, the control valve member 73 being at its closed position, as shown, and both the opening hydraulic surface 57 and the closing hydraulic surface 58 of needle valve member 56 being exposed to fluid pressure in the common rail 11. Fuel injector 15 may also be considered to have an injection configuration that includes the armature 51 being at its energized position as previously described, the control valve member 73 being at its open position, and the common rail 11 being fluidly connected to the drain outlet 19 through both the A-orifice 41 and the Z-orifice 40. The injection configuration may also include the common rail 11 being fluidly connected to the drain outlet 19 through the F-orifice 42 and the E-orifice 33. Finally, fuel injector 15 may be considered to have a dynamic overtravel configuration that includes the control valve member 73 being at its closed position, and the armature 51 moving relative to the control valve member 73 in a downward direction beyond the stable un-energized position such that the annular bevel of stem 61 disengages from clip 67 at frusto-conical surface 70.

INDUSTRIAL APPLICABILITY

The present disclosure is generally applicable to fuel injectors for internal combustion engines. The present disclosure finds specific applicability to fuel injectors for compression ignition engines. Although the present disclosure is illustrated in the context of a common rail fuel injector, the control valve teachings could also find applicability in other types of fuel injectors, such as a control valve for a cam actuated fuel injector, or maybe even a hydraulically actuated fuel injector of a type well known in the art. Although the present disclosure is described in the context of a pressure control valve, the teachings of the present disclosure could also find applicability in other control valves for fuel injectors, such as maybe in relation to a spill valve for a cam actuated fuel injector.

Referring again in the figures, an injection event may be initiated by energizing solenoid coil 52 to move armature 51 from a stable un-energized position toward an energized position at which stem 61 contacts stop 53. When this occurs, hydraulic pressure in needle control chamber 32 act to hydraulically push control valve member 73, as well as pusher 64, upward from the closed position toward the open position. When this occurs, needle control chamber 32 becomes fluidly connected to drain outlet 19 causing pressure in needle control chamber 32 to drop. When this occurs, the hydraulic pressure acting on opening hydraulic surface 57 overcomes the downward mechanical force of biasing spring 82 as well as the residual pressure acting on closing hydraulic surface 58 to allow needle valve member 56 to move upward to open the fluid connection between nozzle chamber 31 and nozzle outlets 18 to commence the injection of fuel into the engine combustion space. An injection event may be ended by de-energizing solenoid coil 52 to allow armature 51 to move downward under the action of valve spring 80 from its energized position toward its stable un-energized position. When this occurs, the control valve member 73 will be mechanically pushed toward its closed position under the action of valve spring 80 acting through spacer 85, thrust surface 69 of clip 67 in contact with pusher 64.

Bounce of the control valve member 73 off of flat seat 74 may be inhibited by moving armature 51, and stem 61, beyond the stable un-energized position toward an overtravel position after control valve member 73 has reached its closed position. This overtravel action is facilitated by telescopic movement of the stem 61 into pusher 64. During the dynamic overtravel of armature 51, the overtravel spring 81 serves to decelerate the armature and eventually return it to its stable un-energized position to reset fuel injector 15 for a subsequent injection event. The term "stable" is intended to mean the rest position of the armature 51 after movement ceases when solenoid coil 52 is de-energized. During the dynamic overtravel of armature 51, the annular bevel of stem 61 may briefly move out of contact with the retention shoulder 68 of clip 67. The overtravel action of the present disclosure reduces the impact energy when the control valve member 73 contacts flat valve seat 74, thus reducing the likelihood that it will bounce. Avoiding bounce can reduce the occurrence of undesirable secondary injection events, and hasten the time necessary for the armature 51 to return to its stable un-energized position for resetting for a subsequent injection event. For instance, a quicker settling out of fuel injector 15 may permit for greater control over dwell times between injection events, including dwell times between a main injection event and a small post injection event in one engine cycle.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims.

What is claimed is:

1. A fuel injector comprising:

an injector body defining a fuel inlet, a set of nozzle outlets and a drain outlet and including a nozzle chamber and a needle control chamber disposed therein;

a needle control valve that includes a control valve member movable between a closed position in contact with a valve seat at which the needle control chamber is blocked to the drain outlet, and an open position out of contact with the valve seat at which the needle control chamber is fluidly connected to the drain outlet;

an electrical actuator mounted in the injector body and including an armature movable between an overtravel position and an energized position, and having a stable un-energized position between the overtravel position and the energized position;

a needle valve member positioned in the injector body and including an opening hydraulic surface exposed to fluid pressure in the nozzle chamber and a closing hydraulic surface exposed to fluid pressure in the needle control chamber; and a telescoping armature pin with a stem affixed to the armature and a pusher in contact with the control valve member, and one of the stem and the pusher telescopically receiving the other of the stem and the pusher.

2. The fuel injector of claim 1 including a clip with a retention shoulder in contact with the stem and a thrust surface in contact with the pusher when the armature is at the stable un-energized position; and the retention shoulder being out of contact with the stem when the armature is at the overtravel position.

3. The fuel injector of claim 2 wherein the retention shoulder is a portion of a frustoconical surface; and the stem is received in a slot defined by the clip.

4. The fuel injector of claim 1 wherein the injector body includes a guide component in guide contact with the stem;

a valve spring positioned between the guide component and the pusher; and an overtravel spring positioned between guide component and the armature.

5. The fuel injector of claim 1 wherein the valve seat is a flat valve seat; and the control valve member includes a spherical surface in contact with an annular orientation neutral surface of the pusher.

6. The fuel injector of claim 1 wherein the needle control chamber is fluidly connected to the nozzle chamber by two unobstructed passageways; and the nozzle chamber being fluidly connected to the fuel inlet by a nozzle supply passage; and the injector body includes a conical seat surrounding the fuel inlet.

7. The fuel injector of claim 1 wherein the needle control chamber is partially defined by an insert;

a biasing spring operably positioned in the injector body to bias the needle valve member and the insert in opposite directions.

8. The fuel injector of claim 1 wherein the armature is separated from a stator by an initial air gap at the stable un-energized position;

the armature is separated from the stator by a final air gap at the energized position, but the stem being in contact with a stop when the armature is at the energized position; and the injector body including a ring that surrounds the armature and defines the initial air gap.

9. The fuel injector of claim 1 wherein the injector body includes a pressure containment sleeve that is out of contact with the needle valve member and defines a segment of the nozzle chamber; and the needle control chamber is partially defined by a small cylinder positioned inside the pressure containment sleeve in guide contact with the needle valve member.

10. The fuel injector of claim 1 wherein the stem is received in a guide bore defined by the pusher; and the stem and the pusher define a fluid chamber fluidly connected to the drain outlet by a fluid displacement passage defined by the pusher.

11. The fuel injector of claim 1 wherein the needle control chamber is fluidly connected to the nozzle chamber through a Z orifice, an A orifice and an F orifice;

the needle control chamber is fluidly connected to the drain outlet through the A orifice and an E orifice when the control valve member is at the open position.

12. The fuel injector of claim 1 wherein the injector body includes a disk that includes the valve seat on one side and an insert seat on an opposite side;

the valve seat is a flat seat, but the insert seat is a conical seat; and the disk defines a portion of the nozzle chamber.

13. A common rail fuel system comprising:

a common rail with a high pressure inlet and a plurality of high pressure outlets;

a plurality of fuel injectors, each including a common rail inlet fluidly connected to one of the plurality of high pressure outlets, and each further including an electronically controlled valve with an armature movable between an overtravel position and an energized position, and having a stable un-energized position between the overtravel position and the energized position, and the electronically controlled valve including a telescoping armature pin with a stem affixed to the armature and a pusher in contact with a control valve member, and the pusher telescopically receiving the stem;

a high pressure pump with an outlet fluidly connected to the high pressure inlet of the common rail, and a low pressure inlet fluidly connected to a fuel tank; and each of the plurality of fuel injectors includes a drain outlet fluidly connected to the fuel tank.

14. The common rail fuel system of claim 13 wherein each of the plurality of fuel injectors includes a needle valve member positioned in the injector body and including an opening hydraulic surface exposed to fluid pressure in a nozzle chamber and a closing hydraulic surface exposed to fluid pressure in a needle control chamber; and the electronically controlled valve includes a control valve member movable between a closed position in contact with a valve seat at which the needle control chamber is blocked to the drain outlet, and an open position out of contact with the valve seat at which the needle control chamber is fluidly connected to the drain outlet.

15. The common rail fuel system of claim 14 wherein each of the plurality of fuel injectors has a stable non-injection configuration, an injection configuration and a dynamic overtravel configuration;

wherein the stable non-injection configuration includes the armature being at the stable un-energized position, the control valve member being at the closed position, and both the opening hydraulic surface and the closing hydraulic surface being exposed to pressure in the common rail;

wherein the injection configuration includes the armature being at the energized position, the control valve member being at the open position, and the common rail being fluidly connected to the drain outlet through an A orifice and a Z orifice; and wherein the dynamic overtravel configuration includes the control valve member being at the closed position and the armature moving relative to the control valve member beyond the stable un-energized position.

16. The common rail fuel system of claim 15 wherein the injection configuration includes the common rail being fluidly connected to the drain outlet through an F orifice and an E orifice.

17. A method of operating a fuel injector that includes an injector body defining a fuel inlet, a set of nozzle outlets and a drain outlet and including a nozzle chamber and a needle control chamber disposed therein; a needle control valve that includes a control valve member movable between a closed position in contact with a valve seat at which the needle control chamber is blocked to the drain outlet, and an open position out of contact with the valve seat at which the needle control chamber is fluidly connected to the drain outlet; and, a needle valve member positioned in the injector body and including an opening hydraulic surface exposed to fluid pressure in the nozzle chamber and a closing hydraulic surface exposed to fluid pressure in the needle control chamber; and, the method comprising the steps of:

initiating an injection event by moving the armature from the stable un-energized position toward the energized position and hydraulically pushing the control valve member from the closed position toward the open position;

ending an injection event by moving the armature from the energized position toward the stable un-energized position and mechanically pushing the control valve member toward the closed position;

inhibiting bounce of the control valve member off the valve seat by moving the armature beyond the stable un-energized position toward an overtravel position after the control valve member has reached the closed position; and the inhibiting step includes telescopically moving the stem in the pusher.

18. The method of claim 17 wherein the initiating step includes energizing a solenoid coil;

the ending step includes de-energizing the solenoid coil and moving the armature and control valve member with a valve spring; and the inhibiting step includes decelerating the armature with an overtravel spring.

19. The method of claim 18 including a step of resetting the fuel injector for a subsequent injection event by pushing the armature from the overtravel position toward the stable un-energized position with the overtravel spring.

20. The method of claim 19 wherein the inhibiting step includes moving the stem out of contact with a retention shoulder of a clip.

* * * * *